US010657901B2

(12) United States Patent
Choi et al.

(10) Patent No.: US 10,657,901 B2
(45) Date of Patent: May 19, 2020

(54) PULSE-WIDTH MODULATION BASED ON IMAGE GRAY PORTION

(71) Applicant: Microsoft Technology Licensing, LLC, Redmond, WA (US)

(72) Inventors: Minhyuk Choi, Mill Creek, WA (US); Samu Matias Kallio, Redmond, WA (US); Ying Zheng, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/786,326

(22) Filed: Oct. 17, 2017

(65) Prior Publication Data

US 2019/0114971 A1 Apr. 18, 2019

(51) Int. Cl.

| | |
|---|---|
| ***G09G 3/3266*** | (2016.01) |
| ***G09G 3/20*** | (2006.01) |
| ***G09G 3/3208*** | (2016.01) |

(52) U.S. Cl.

CPC ..... *G09G 3/3266* (2013.01); *G09G 3/2011* (2013.01); *G09G 3/2014* (2013.01); *G09G 3/3208* (2013.01); *G09G 2310/027* (2013.01); *G09G 2320/0238* (2013.01); *G09G 2320/0242* (2013.01); *G09G 2320/0285* (2013.01);

(Continued)

(58) Field of Classification Search

CPC combination set(s) only.

See application file for complete search history.

(56) References Cited

U.S. PATENT DOCUMENTS

| | | | |
|---|---|---|---|
| 6,384,806 | B1 | 5/2002 | Matsueda et al. |
| 6,388,648 | B1 | 5/2002 | Clifton et al. |

(Continued)

FOREIGN PATENT DOCUMENTS

| | | | |
|---|---|---|---|
| EP | 1225557 | A1 | 7/2002 |
| EP | 2881933 | A1 | 6/2015 |
| KR | 20030017222 | A | 3/2003 |

OTHER PUBLICATIONS

"Non Final Office Action Issued in U.S. Appl. No. 15/786,210", dated Oct. 12, 2018, 10 Pages.

(Continued)

*Primary Examiner* — Amare Mengistu
*Assistant Examiner* — Crystal Mathews
(74) *Attorney, Agent, or Firm* — Holzer Patel Drennan

(57) ABSTRACT

Varying electrical currents are selectively applied to each pixel within an OLED display to create desired images. High applied electrical currents to groupings of nearby pixels create high luminance features, while low applied electrical currents to groupings of nearby pixels create low luminance features. A combination of a high luminance and low luminance features may be present on the OLED display. Pulse-width modulation (PWM) is often used to increase the current applied to the OLED display by modulating the applied current, particularly when creating low luminance features. The presently disclosed systems and methods detect a gray portion of an image to be presented, and select PWM independently of peak luminance based on the detected gray portion. The allows the OLED display to display low-luminance features at high quality, even when high-luminance features are also present within a frame.

20 Claims, 4 Drawing Sheets

(52) U.S. Cl.
CPC . *G09G 2320/0673* (2013.01); *G09G 2340/14* (2013.01); *G09G 2360/16* (2013.01); *G09G 2360/18* (2013.01)

(56) References Cited

U.S. PATENT DOCUMENTS

| | | | | |
|---|---|---|---|---|
| 6,750,839 | B1 | 6/2004 | Hogan | |
| 6,795,063 | B2 | 9/2004 | Endo et al. | |
| 6,950,045 | B2 | 9/2005 | Kim | |
| 7,068,283 | B2 | 6/2006 | Huang | |
| 7,443,540 | B2 | 10/2008 | Kasai et al. | |
| 9,654,747 | B2 | 5/2017 | Asada | |
| 2002/0130830 | A1* | 9/2002 | Park | G09G 3/3406 345/99 |
| 2002/0145584 | A1* | 10/2002 | Waterman | G09G 3/2011 345/98 |
| 2003/0142084 | A1* | 7/2003 | Chang | G09G 3/20 345/204 |
| 2004/0114396 | A1* | 6/2004 | Kobayashi | G02B 6/0076 362/561 |
| 2005/0041007 | A1* | 2/2005 | Iijima | G09G 3/3622 345/101 |
| 2005/0140640 | A1* | 6/2005 | Oh | G09G 3/3406 345/102 |
| 2005/0212736 | A1 | 9/2005 | Lu et al. | |
| 2005/0219271 | A1 | 10/2005 | Tanaka | |
| 2006/0077200 | A1* | 4/2006 | Tamayama | G06F 1/3218 345/211 |
| 2007/0126757 | A1* | 6/2007 | Itoh | G09G 3/3233 345/690 |
| 2008/0001881 | A1* | 1/2008 | Baba | G09G 3/3406 345/89 |
| 2009/0091528 | A1* | 4/2009 | Hong | G09G 3/3406 345/102 |
| 2009/0167782 | A1 | 7/2009 | Petljanski et al. | |
| 2009/0243982 | A1* | 10/2009 | Lee | G09G 3/3406 345/88 |
| 2010/0109992 | A1* | 5/2010 | Sumi | G09G 3/3648 345/89 |
| 2010/0110065 | A1* | 5/2010 | Abe | G09G 3/3216 345/213 |
| 2010/0156777 | A1* | 6/2010 | Kang | G09G 3/342 345/102 |
| 2012/0069022 | A1 | 3/2012 | Majumder et al. | |
| 2012/0105515 | A1* | 5/2012 | Iwasaki | G09G 3/3406 345/691 |
| 2013/0021386 | A1* | 1/2013 | Min | G09G 3/34 345/690 |
| 2013/0127924 | A1* | 5/2013 | Lee | G09G 3/32 345/690 |
| 2014/0125714 | A1* | 5/2014 | Pyo | G09G 3/3233 345/691 |
| 2015/0042696 | A1* | 2/2015 | Ooga | G09G 3/3406 345/690 |
| 2015/0091950 | A1 | 4/2015 | Park | |
| 2015/0097764 | A1* | 4/2015 | Pyo | G09G 3/3233 345/77 |
| 2015/0097872 | A1* | 4/2015 | Jeong | G09G 3/3225 345/690 |
| 2015/0103105 | A1* | 4/2015 | Kim | G09G 3/2092 345/690 |
| 2015/0154913 | A1* | 6/2015 | Kim | G09G 3/3233 345/691 |
| 2015/0161941 | A1* | 6/2015 | Lim | G09G 3/3208 345/691 |
| 2015/0371594 | A1* | 12/2015 | Huang | G09G 3/003 345/690 |
| 2016/0117997 | A1* | 4/2016 | Matsui | H05B 33/0845 345/691 |
| 2016/0225327 | A1* | 8/2016 | Jang | G09G 3/3413 |
| 2016/0284323 | A1* | 9/2016 | Neugebauer | G09G 5/397 |
| 2016/0329019 | A1* | 11/2016 | An | G09G 3/20 |
| 2016/0351102 | A1* | 12/2016 | Shin | G09G 3/2007 |
| 2017/0162094 | A1 | 6/2017 | Jee | |
| 2017/0168734 | A1 | 6/2017 | Zhang | |
| 2017/0208661 | A1* | 7/2017 | Hussain | H05B 33/0851 |
| 2018/0061333 | A1* | 3/2018 | Chu | G02F 1/133603 |
| 2018/0174538 | A1* | 6/2018 | Lee | G09G 3/3648 |
| 2019/0005898 | A1* | 1/2019 | Albrecht | G06F 1/1643 |
| 2019/0027084 | A1* | 1/2019 | Lee | G09G 3/2018 |
| 2019/0053342 | A1* | 2/2019 | Shih | H05B 33/0845 |
| 2019/0114963 | A1 | 4/2019 | Choi et al. | |

OTHER PUBLICATIONS

"DSVGA: 800 X 600 Low Power Monochrome Green XLT Amoled Microdisplay", Retrieved From <<https://www.google.co.in/url?sa=t&rct=j&q=&esrc=s&source=web&cd=4&cad=rja&uact=8&ved=0ahUKEwiP15iF-uLUAhUHuY8KHcSTDMwQFgg4MAM&url=http%3A%2F%2Fbiakom.com%2Fpdf%2FDSVGA-E-Magin.pdf&usg=AFQjCNH9zkID1ixbHcU57ACkAgs3VQqXxg>>, May 8, 2015, pp. 1-85.

"Invitation to Pay Additional Fees and Partial International Search issued in PCT Application No. PCT/US18/055111", dated Jan. 8, 2019, 15 Pages.

"International Search Report and Written Opinion Issued in PCT Application No. PCT/US2018/055111", dated Feb. 25, 2019, 19 Pages.

"Final Office Action Issued in U.S. Appl. No. 15/786,210", dated Apr. 25, 2019, 11 Pages.

"International Search Report and Written Opinion Issued in PCT Application No. PCT/US2018/055110", dated Jan. 31, 2019, 10 Pages.

* cited by examiner

PULSE-WIDTH MODULATION BASED ON IMAGE GRAY PORTION

BACKGROUND

With increasing consumer expectations of digital display performance, including accurate and consistent image quality, image variations at low gray levels are increasingly unacceptable to consumers. Further, as consumer devices increasingly incorporate multiple displays oriented in close proximity to one another, variations in image quality are more noticeable to consumers. While display devices often utilize pulse-width modulation (PWM) to improve image quality at low gray levels, selection of PWM is typically based on peak luminance and not varying display gray portion over time.

SUMMARY

Implementations described and claimed herein provide a computing device comprising a self-emitting electroluminescent display and a PWM controller. The PWM controller calculates a gray portion of an input display signal, selects a PWM duty ratio based on the calculated gray portion, and outputs a pulse-modulated display signal to the display.

Implementations described and claimed herein further provide a method of modulating an output for a display comprising receiving an input display signal, calculating a gray portion of the input display signal, selecting a PWM duty ratio based on the calculated gray portion, applying the selected PWM duty ratio to the input display signal to create a pulse-modulated display signal, and outputting the pulse-modulated display signal to the display.

Implementations described and claimed herein still further provide a computer-readable medium containing processor-executable instructions. The processor-executable instructions, when executed by a processor, cause the processor to receive an input display signal, calculate a gray portion of the input display signal, select a PWM duty ratio based on the calculated gray portion, apply the selected PWM duty ratio to the input display signal to create a pulse-modulated display signal, and output the pulse-modulated display signal to the display.

Other implementations are also described and recited herein. This Summary is provided to introduce a selection of concepts in a simplified form that are further described below in the Detailed Descriptions. This Summary is not intended to identify key features or essential features of the claimed subject matter, nor is it intended to be used to limit the scope of the claimed subject matter.

BRIEF DESCRIPTIONS OF THE DRAWINGS

DETAILED DESCRIPTIONS

In an organic light-emitting diode (OLED) display, an emissive electroluminescent layer selectively emits light in discrete areas in response to an applied electric current. Varying electrical currents are selectively applied to each pixel within the OLED display to create desired images. High electrical currents applied to groupings of nearby pixels create high luminance (or brightness) features, while low electrical currents applied to groupings of nearby pixels create low luminance (or brightness) features. A combination of high luminance and low luminance features may be presented to a user on an OLED display, which may vary frame-by-frame, over time.

A transfer curve defines a relationship between current and voltage applied to the OLED display to create varied luminance features. Higher currents used to create higher luminance features are applied at a stable voltage level and yield generally high-quality images. However, lower currents used to create lower luminance features may be applied at a lower voltage level that may approach a threshold voltage (or a turn-on voltage), which is increasingly unstable or inconsistent. This yields increasingly unstable or inconsistent low luminance images output on the OLED display.

Pulse-width modulation (PWM) is often used to increase the current applied to the OLED display to a position on the transfer curve away from the threshold voltage by modulating the applied current, particularly when creating low luminance features. More specifically, a pulsing signal at a higher current rather than a constant signal at a lower current is applied to the OLED display. The duty ratio of the pulsing signal is chosen such that total applied current for a particular frame to be presented on the OLED display is equal to that of the constant signal at the lower current. As a result, the created image has the same luminance, but improved quality, particularly for low luminance features.

As applying PWM to increase the current applied to the OLED display consumes computing resources (and associated power) driving the OLED display, PWM is often selected only for frames that have a peak luminance below a threshold. However, some of the frames with a peak luminance above the threshold may still significantly benefit from PWM. The presently disclosed systems and methods detect a gray portion of an image to be presented, and select PWM independently of peak luminance based on the detected gray portion exceeding a threshold. This allows the OLED display to display low-luminance features that make up a substantial portion of a frame at high quality, even when high-luminance features are also present within the frame.

Figure 1:
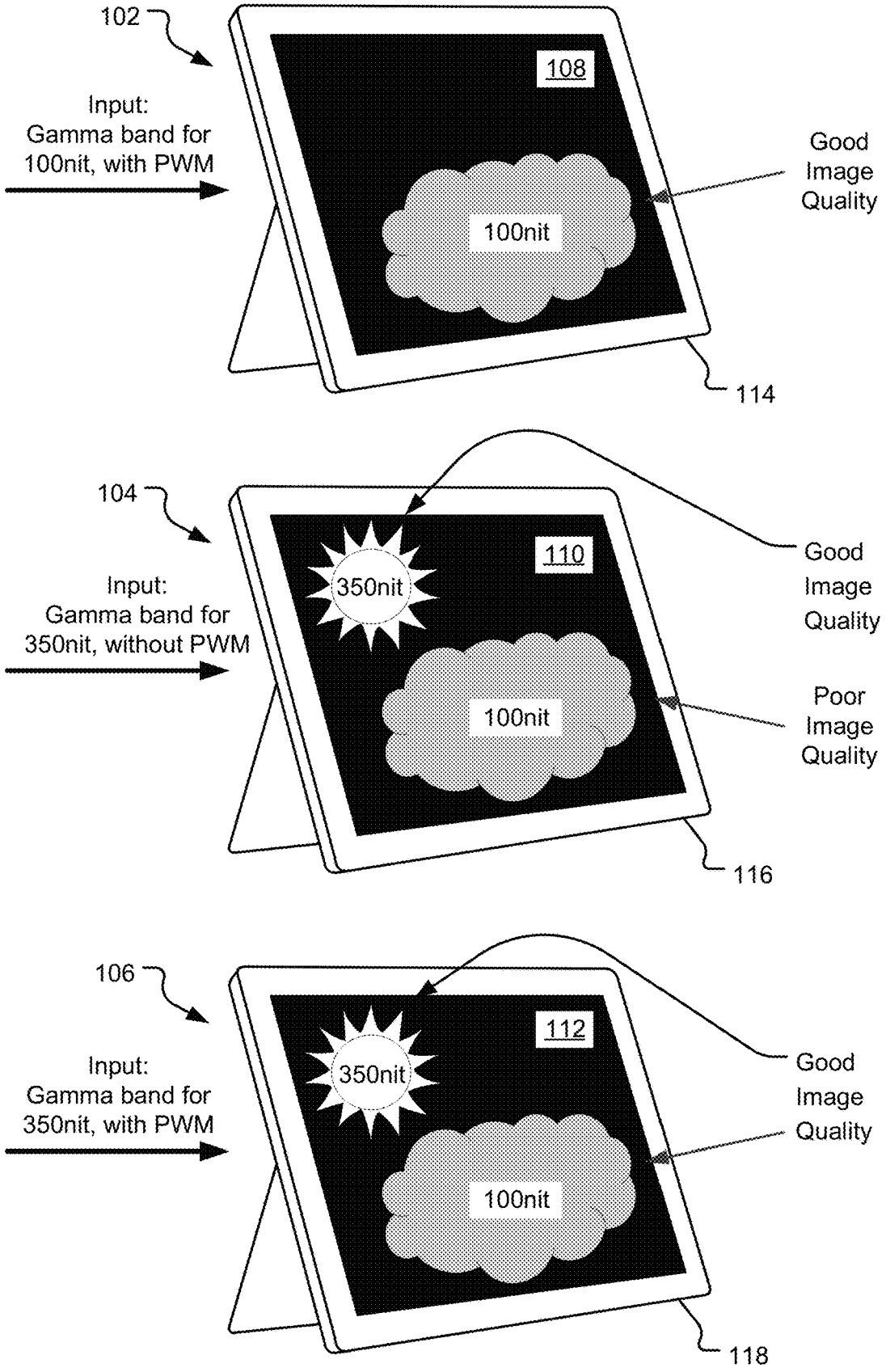
FIG. 1 illustrates three tablet computers with organic light-emitting diode (OLED) displays presenting different luminance features, created with and without pulse-width modulation (PWM).

FIG. 1 illustrates three tablet computers 102, 104, 106 with OLED displays 108, 110, 112 presenting different luminance features, created with and without PWM. The tablet computers 102, 104, 106 include OLED displays 108, 110, 112 respectively, that span front-facing surfaces and chassis 114, 116, 118 respectively, that occupy rear-facing surfaces of the tablet computers 102, 104, 106. The chassis 114, 116, 118 and OLED displays 108, 110, 112, respectively, in combination, serve as protective covers and mounting structures for internal electronic components (e.g., structural framework, printed circuit boards, microprocessors, integrated circuits, electronic storage devices, cooling components, cameras, antennas, speakers, microphones, and batteries) of the tablet computers 102, 104, 106. The OLED displays 108, 110, 112 and/or the chassis 114, 116, 118, may also occupy side-facing surfaces of the tablet computers 102, 104, 106, respectively, and in combination encompass the internal electronic components of the tablet computers 102, 104, 106.

Each of the OLED displays 108, 110, 112 presents one or more features within a frame having varied luminance values. A series of gamma bands for adjusting luminance as a function of gray level (G) are predefined for each of the displays 108, 110, 112. In various implementations, gamma bands as used herein may refer to electrical control values for red-green-blue (RGB) values defining content to be presented on the OLED displays 108, 110, 112. Further, a gamma band may be defined as an electro-optical transfer function (EOTF) for the RGB values defining the content to be presented on the OLED displays 108, 110, 112. The gamma band most closely matching a peak luminance of the features within a frame is selected for presenting the features of that frame. Typically, PWM is applied for gamma bands with a peak luminance below a threshold value.

By way of example, the OLED display 108 presents an image of a gray cloud with a relatively low luminance (e.g., 100 nit) against a darker (or black) background. One of the series of gamma bands is selected which corresponds to a peak luminance of 100 nit. Assuming 100 nit is below a predetermined PWM threshold (e.g., up to and including 100 nit), PWM is applied to the selected gamma band to generate the image of the gray cloud. While the gray cloud has a relatively low luminance value, as PWM was applied to generate the gray cloud, the image quality of the gray cloud is relatively good.

The OLED display 110, which operates conventionally, presents an image of a gray cloud with a relatively low luminance (e.g., 100 nit) similar to that of the OLED display 108 along with an image of a bright sun with a relatively high luminance (e.g., 350 nit), also against a darker (or black) background. One of the series of gamma bands is selected that corresponds to a peak luminance of 350 nit. Assuming 350 nit is above the predetermined PWM threshold (e.g., up to and including 100 nit), PWM is not applied to the selected gamma band to generate the image of the gray cloud and the bright sun. As the gray cloud has a relatively low luminance value and PWM was not applied due to the high luminance of the bright sun, the gray cloud has a relatively poor image quality, while the bright sun has a relatively good image quality.

The OLED display 112, which operates according to the presently disclosed technology, presents an image of the gray cloud with a relatively low luminance (e.g., 100 nit) along with an image of a bright sun with a relatively high luminance (e.g., 350 nit) against a darker (or black) background, which is similar to that of the OLED display 110. One of the series of gamma bands is selected that corresponds to a peak luminance of 350 nit. Assuming 350 nit is above the predetermined PWM threshold (e.g., up to and including 100 nit), PWM is not applied to the selected gamma band to generate the image of the gray cloud and the bright sun based on peak luminance.

However, the OLED display 112 may select PWM independently of peak luminance based on the detected gray portion exceeding a threshold. This may be in addition to or in lei of selecting PWM based on peak luminance. The OLED display 112 performs a calculation of gray portion of the entire depicted frame (or a portion thereof). If the gray portion exceeds a threshold (e.g., 30-50%), PWM is applied based on the gray portion present within the depicted frame. As the gray cloud has a relatively low luminance value and PWM was applied despite the high luminance of the bright sun, both the gray cloud and the bright sun have a relatively good image quality.

In various implementations, good image quality as used herein lacks significant mura defects (e.g., non-uniformity distortions in luminance and/or color), while poor image quality as used herein contains significant mura. In various implementations, significant mura of spatial non-uniformities can be quantified by lower spatial color difference, as defined by CIELAB Delta E* of the image.

While the OLED displays 108, 110, 112 are each shown displaying one or both of a gray cloud and a bright sun against a dark (or black) background, the OLED displays 108, 110, 112 may display any image or combination of images. Any image (or combination of images) may be used to calculate a gray portion of each frame presented on each of the OLED displays 108, 110, 112, which may in turn be used to determine whether to apply PWM to a particular frame presented on a particular one of the OLED displays 108, 110, 112. Further, while color is not specifically discussed above, the gray portion may be calculated from an image (or combination of images) that includes any number of colors defined within any color space.

Further, while the presently disclosed technology is specifically described with reference to OLED displays for tablet computers, it may apply to other self-emitting electroluminescent display technologies with similar current-voltage transfer curves (e.g., passive-matrix OLED (PMOLED), active-matrix OLED (AMOLED), non-organic LED, fluorescent, or other display technologies). Still further, the OLED (or other type) displays described in detail herein may be incorporated into a variety of computing devices that include or connect to a display (e.g., laptop computers, personal computers, gaming devices, smart phones, smart TVs, or other devices that carry out one or more specific sets of arithmetic and/or logical operations).

Figure 2:
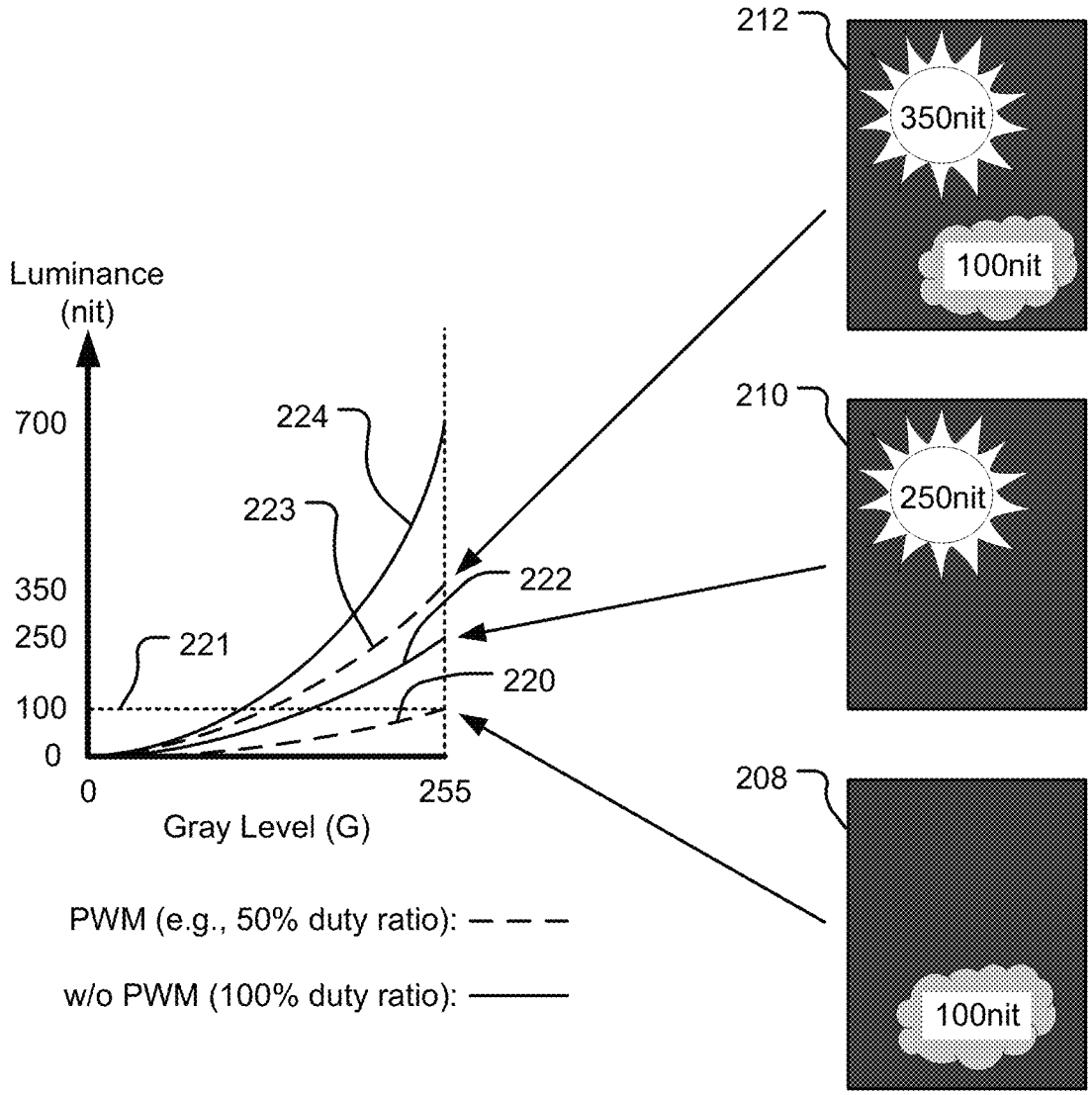
FIG. 2 illustrates a series of gamma bands, applied with and without PWM.

FIG. 2 illustrates a series of gamma bands 220, 222, 223, 224, applied with and without PWM. The gamma bands 220, 222, 223, 224 are plotted as luminance values as a function of display gray level to create a gamma signal based on peak luminance of a frame to be presented on an associated OLED display (e.g., OLED displays 208, 210, 212). The gray level is illustrated from 0 G (black) to 255 G (white) and luminance from 0 nit to 700 nit. Other gray level or luminance scales and ranges may be used with similar effect. An overall gray portion of each frame presented on the OLED displays 208, 210, 212 may be calculated by averaging (or otherwise creating a composite) gray level of each (or a selection) of the pixels within each (or a selection) of the frames presented by the OLED displays 208, 210, 212.

For example, the OLED display 208 presents an image of a gray cloud with a relatively low luminance (e.g., 100 nit) against a darker (or black) background. Gamma band 220 is selected which corresponds to a peak luminance of 100 nit. As the gamma band 220 remains at or below a predetermined PWM threshold (also 100 nit, illustrated by dotted line 221), PWM (e.g., at 50% duty ratio) is applied to gamma band 220 to generate the image of the gray cloud (illustrated by a dashed curve). While the gray cloud has a relatively low luminance value, as PWM was applied to generate the gray cloud, the image quality of the gray cloud is relatively good.

The OLED display 210 presents an image of a sun with a medium luminance (e.g., 250 nit), also against a darker (or black) background. Gamma band 222 is selected that corresponds to a peak luminance of 250 nit. As the gamma band 222 peaks above the predetermined PWM threshold of 100 nit, PWM is not applied to the gamma band 222 based on peak luminance. Further, a gray portion of the image presented by the OLED display 210 is calculated and remains below a threshold for applying PWM based on gray portion (e.g., a 30-50% gray portion threshold). As a result, the image of the medium luminance sun is generated without PWM (illustrated by a solid curve), but is presented with a relatively good image quality.

The OLED display 212 presents an image of a gray cloud with a relatively low luminance (e.g., 100 nit) along with an image of a bright sun with a relatively high luminance (e.g., 350 nit) against a darker (or black) background. Gamma band 223 is selected that corresponds to a peak luminance of 350 nit. As the gamma band 223 peaks above the predetermined PWM threshold of 100 nit, PWM is not applied to the gamma band 223 based on peak luminance. Further, a gray portion of the image presented by the OLED display 212 is calculated and is above a threshold for applying PWM based on gray portion (e.g., 30-50% gray portion). As a result, the image of the gray cloud and the bright sun is generated with PWM (e.g., at 50% duty ratio, illustrated by a dashed curve), and is presented with a relatively good image quality for both the gray cloud and the bright sun.

Gamma band 224 has a relatively high peak luminance (e.g., 700 nit) and PWM would not be applied to gamma band 224 unless a gray portion of a corresponding image (not shown) is above a threshold for applying PWM. The relatively high voltage applied to generate 700 nit at 100% duty ratio is equal to the voltage applied to generate 350 nit at 50% duty ratio. Thus, quality of a resulting image with peak luminance of 700 nit at 100% duty ratio may be approximately equal to another resulting image with peak luminance of 350 nit at 50% duty ratio.

While the OLED displays 208, 210, 212 each display one or both of a gray cloud and a sun against a dark (or black) background, other images with other or additional colors may be used to select one of the gamma bands 220, 222, 223, 224 based on the peak luminance, calculate a gray portion of the overall image, and select PWM based on at least the calculated gray portion of the overall image. Further, while the gamma bands 220, 222, 223, 224 are shown for illustration purposes, equations defining the gamma bands 220, 222, 223, 224 and/or look-up tables (LUTs) defining an array of points on each of the gamma bands 220, 222, 223, 224 are stored within a memory or a data storage (see e.g., memory device(s) 450 and storage device(s) 460 of FIG. 4) for access by a computing system (e.g., computing system 400 of FIG. 4). Still further, while three distinct images are presented by the OLED displays 208, 210, 212 and the corresponding gamma bands 220, 222, 223 are shown and described above, any number of gamma bands may be used to adjust an input display signal based on peak luminance prior to output to the OLED displays 208, 210, 212. Further, any number of PWM duty ratios may be available for selection based on the calculated gray portion.

Figure 3:
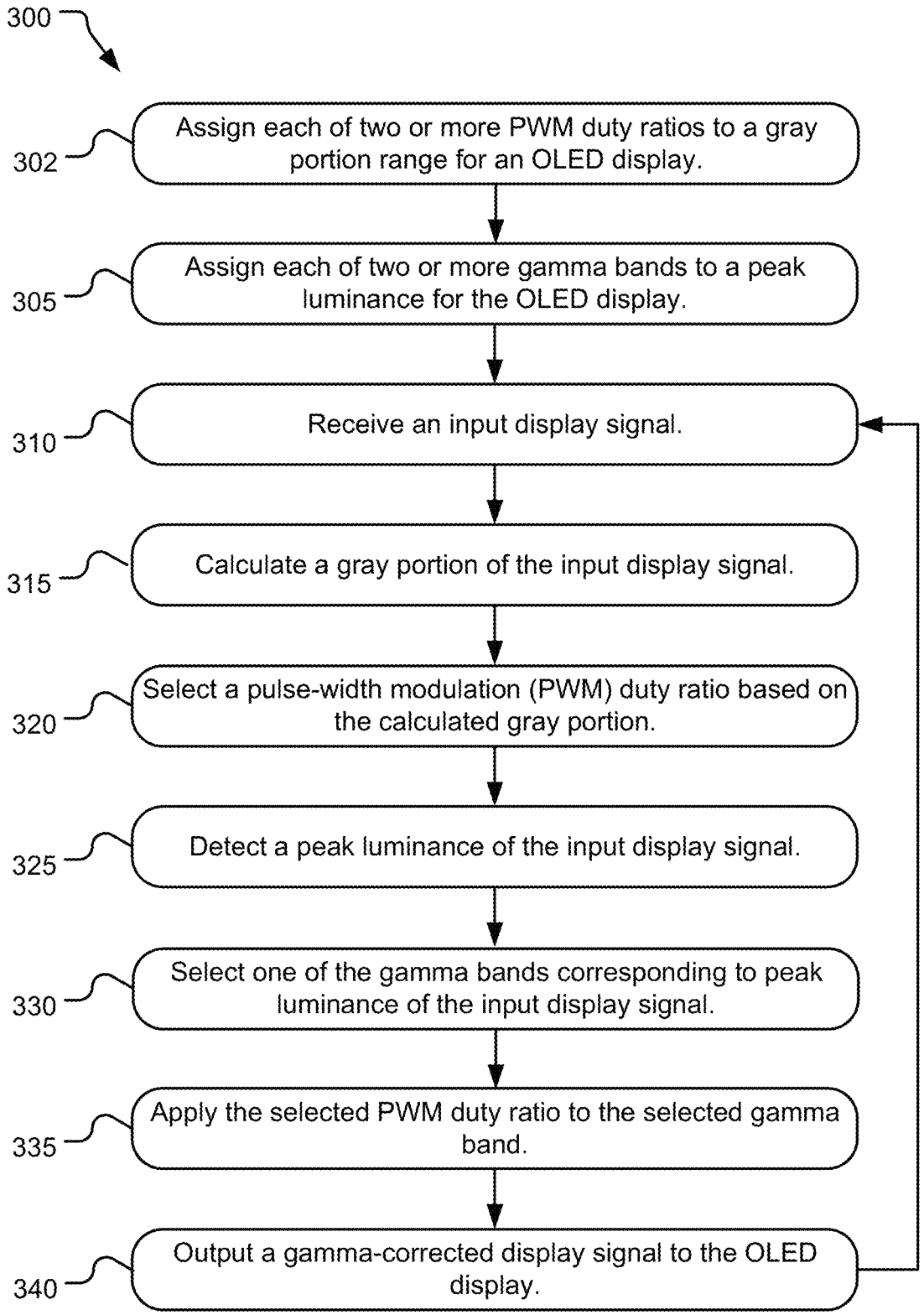
FIG. 3 illustrates example operations for applying PWM based on gray portion within an image for output on an OLED display.

FIG. 3 illustrates example operations 300 for applying PWM based on gray portion within an image for output on an OLED display. The operations 300 may be referred to herein as a "gray-portion aware" gamma correction process. A first assigning operation 302 assigns each of two or more PWM duty ratios to a gray portion range for an OLED display. In various implementations, an operable range of gray portion is defined for the OLED display (e.g., 0-100%). The operable range is divided into two or more functional ranges within the operable range, each of which is assigned a PWM duty ratio. In an example 3-ratio system, a 33% duty ratio for calculated gray portions greater than 66%, a 66% duty ratio for calculated gray portions between 33% and 66%, and a 100% duty ratio (also referred to herein as no PWM) for gray portions less than 33% are defined. In an example 2-ratio system, the operable range is divided between applying PWM to the input display signal (e.g., operating at a 50% duty ratio at high gray portions) or not applying PWM to the input display signal (e.g., operating at a 100% duty ratio at low gray portions) based on a threshold gray portion (e.g., 30-50%). In various implementations, quantity and specific values of the PWM duty ratios and the corresponding gray portion ranges may be predetermined empirically for best performance when applied to the OLED display. Systems with more PWM duty ratios may include increasingly small gray portion ranges. In various implementations, the gray portion ranges may be equally spaced (as described above) or otherwise, depending on projected operating conditions of the OLED display.

A second assigning operation 305 assigns each of two or more gamma bands to a peak luminance for the OLED display. In various implementations, an operable range of luminance is defined for the OLED display (e.g., 0-350 nit). The operable range is divided into two or more functional ranges between 0 nit and a peak luminance, each of which is assigned a gamma correction band. For example, a 3-band system may include 0-50 nit, 0-200 nit, and 0-350 nit gamma correction bands. Similarly, a 5-band system may include 0-50 nit, 0-125 nit, 0-200 nit, 0-275 nit, and 0-350 nit gamma correction bands. Systems with more gamma correction bands may include increasingly small differences between peak luminance values. In various implementations, the peak luminance values may be equidistant between adjacent gamma correction bands (as described above) or otherwise, depending on projected operating conditions of the OLED display.

In some implementations, a peak luminance cutoff for application of PWM independent from gray portion may also be defined. For example, for a 100 nit peak luminance PWM cutoff, all gamma correction bands that peak below 100 nit would automatically have PWM applied regardless of the gray portion of an image to be presented. For gamma correction bands that peak above 100 nit (or another threshold), the following operations are used to calculate and selectively use a gray-portion to determine whether to apply PWM to the image to be presented. In other implementations, application of PWM is solely based on the calculated gray portion of an image to be presented. Further, the assigning operation 305 may be performed on each of a series of OLED displays upon commissioning so that the individual displays have similar (or the same) gamma correction bands and output images that appear similar or identical to a user when multiple OLED displays are placed adjacent one another.

A receiving operation 310 receives an input display signal. The input display signal may be output from a central processing unit (CPU) to a graphics processing unit (GPU), PWM controller, and/or display driver that performs the remainder of the operations 300. In various implementations, the input display signal includes a stream of frames intended for an OLED display, that are collected within a frame buffer associated with the GPU, PWM controller, and/or display driver. The frame buffer functions as a data store or content calculator for the following calculating operation 315.

The calculating operation 315 calculates a gray portion of the input display signal. More specifically, a gray portion calculator scans the frame buffer, selecting all or a subset of pixels (e.g., a regularly spaced array of pixels distributed across the entire frame or an array of pixels distributed within a specific area of the frame) within all or a subset of the frames stored within the buffer (e.g., every frame, every third frame, every $10^{th}$ frame, and so on). In some implementations, a frame histogram may be used to select specific frames for calculating the gray portion of the input display signal (e.g., selecting only frames that are a substantial change from previous or subsequent frames). A gray portion calculation is performed using each of the selected pixels within the selected frames, which computes an average gray portion of an image to be presented to a user.

A first selecting operation 320 selects a PWM duty ratio that corresponds to (or based on) the calculated gray portion. A duty ratio selector chooses one of the available PWM duty ratios. More specifically, the duty ratio selector compares the calculated gray portion of the input display signal against the previously assigned PWM duty ratios to select the most appropriate PWM duty ratio for the calculated gray portion. The previously assigned PWM duty ratios may be stored within memory or data storage as formulae that are applied in real-time to the input display signal, or a series of LUTs that contain values corresponding to the PWM duty ratios. In various implementations, the first selecting operation 320 may be performed by the duty ratio selector within the GPU, PWM controller, and/or display driver. In various implementations, the duty ratio selector may select a PWM duty ratio for each frame, multiple PWM duty ratios for different areas of each frame, or a PWM duty ratio for a series of frames to be presented to the user.

A detecting operation 325 detects peak luminance of the input display signal. More specifically, a display driver scans the frame buffer, selecting all or a subset of pixels (e.g., a regularly spaced array of pixels distributed across the entire frame or an array of pixels distributed within a specific area of the frame) within all or a subset of the frames stored within the buffer (e.g., every frame, every third frame, every $10^{th}$ frame, and so one). Of the selected pixels within the selected frames, the display driver detects a peak luminance. In some implementations, a frame histogram may be used to select specific frames for detecting peak luminance of the input display signal (e.g., selecting only frames that are a substantial change from a previous or subsequent frame).

A second selecting operation 330 selects one of the available gamma bands that corresponds to the detected peak luminance of the input display signal. More specifically, the display driver compares the detected peak luminance of the input display signal against the previously assigned gamma bands to select the most appropriate gamma band for the detected peak luminance. The previously assigned gamma bands may be stored within memory or data storage as formulae that are applied in real-time to the input display signal or a series of LUTs that contain gamma correction values. In various implementations, the second selecting operation 330 may be performed by the display driver within the GPU, PWM controller, and/or display driver. In various implementations, the display driver may select a gamma band for each frame, frame portion, or series of frames to be presented to the user.

An applying operation 335 applies the selected PWM duty ratio to the selected gamma band to create a gamma-corrected output display signal. The applying operation 335 may be performed as a signal-processing operation that modifies the input display signal using the selected PWM duty ratio and the selected gamma band to create the gamma-corrected output display signal. The applying operation 335 may further modify the input display signal for entire frames to be output to the OLED display, or specific areas of the frames where PWM is selectively applied (e.g., areas of the OLED display that are more likely to contain low gray level features). For example, applying PWM based on gray portion to only specific areas of the frames may be used to address artifacts typically present within those specific areas. In various implementations, the applying operation 335 may be performed by a PWM controller, either separate from or within the GPU and/or display driver. In various implementations, the GPU, PWM controller, and/or display driver may perform the applying operation 335 in real-time to modify the input display signal. Additional signal-processing may also be performed by the GPU, PWM controller, and/or display driver on the input display signal prior to outputting operation 340.

The outputting operation 340 outputs the gamma-corrected display signal to the OLED display. As a result, the OLED display may present features with high gray portions to a user at a high quality by selectively using PWM. In some example implementations, the output gray level intended for each pixel across the OLED display may vary by no more than 5% (or 2%) as compared to the gamma-corrected output display signal fed to the OLED display.

In various implementations, the operations 310 may iteratively and automatically repeat to render subsequent frames (or grouping of frames) on the OLED display and iteratively and automatically determine for each frame (or grouping of frames) which gamma band to use, whether to apply PWM, and what duty ratio is used with PWM.

Figure 4:
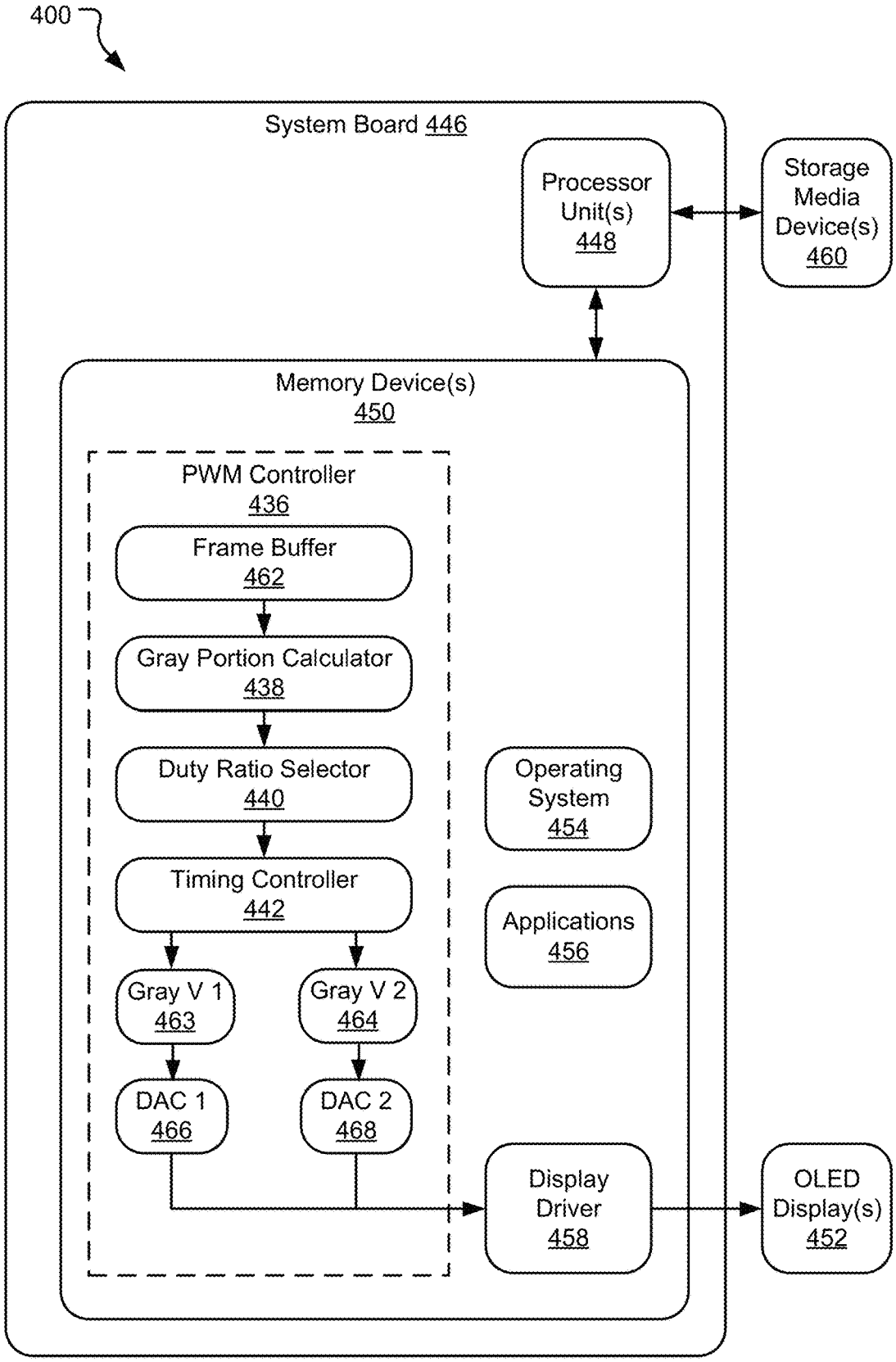
FIG. 4 illustrates a computing system incorporating a PWM controller for an OLED display.

FIG. 4 illustrates a computing system 400 incorporating a PWM controller 436 for an OLED display 452. The computing system 400 may include a system board 446, upon which a variety of microelectronic components for the computing system 400 are attached and interconnected. For example, the system board 446 may include one or more processor units 448 (e.g., discrete or integrated microelectronic chips and/or separate but integrated processor cores, including but not limited to central processing units (CPUs) and graphic processing units (GPUs)), at least one memory device 450 (which may be integrated into systems or chips of the computing system 400), a storage media device(s) 460 (e.g., a flash or hard disk drive), one or more OLED display(s) 452, and other input/output devices (not shown).

The memory device(s) 450 and the storage media device(s) 460 may include one or both of volatile memory (e.g., random-access memory (RAM)) and non-volatile memory (e.g., flash memory or magnetic storage). An operating system 454, such as one of the varieties of the Microsoft Windows® operating system, resides in the memory device(s) 450 and/or the storage media device(s) 460 and is executed by at least one of the processor units 448, although other operating systems may be employed. One or more additional applications 456 are loaded in the memory device(s) 450 and/or the storage media device(s) 460 and executed within the operating system 454 by at least one of the processor units 448.

The memory device(s) 450 and/or the storage media device(s) 460 may further include one or more controllers (e.g., the PWM controller 436) and one or more drivers (e.g., display driver 458), such as a display driver integrated circuit (DDIC). The PWM controller 436 receives an input display signal from the processor unit(s) 448, stores the input display signal within a frame buffer 462, conditions the input display signal, and outputs the conditioned display signal to the display driver 458, which in turn outputs a further conditioned display signal to the OLED display(s) 452. In various implementations, the input display signal includes a sequence of frames for visual representation on the OLED display(s) 452.

The PWM controller 436 receives a series or stream of frames to be presented to a user and stores the frames within the frame buffer 462. Gray portion calculator 438 scans the frame buffer 462, including all or a subset of the pixels within all or a subset of the frames within the frame buffer 462, determines a gray level of each of the scanned pixels, and calculates a mean, median, or other composite gray value of all pixels within a selected frame (referred to herein as gray portion). When expressed as a percentage, the gray portion may range from 0% (representing all white within a grayscale) to 100% (representing all black within the grayscale). A duty ratio selector 440 selects one of at least two available PWM duty ratios for timing controller (TCON) 442 (e.g., a 2-ratio system of 50% and 100% or a 3-ratio system of 33%, 66%, and 100%). The TCON 442 generates a pulsed signal that matches the selected duty ratio.

The selected PWM duty ratio corresponds to a gray scale voltage generator that applies a gray voltage corresponding to the selected PWM duty ratio to the pulsed signal generated by the TCON 442 and a digital-to-analog converter (DAC) that converts the resulting pulsed signal (or modulated emission signal) from a digital input to an analog output to the display driver 458. Here, a 2-ratio system is shown with a first duty ratio corresponding to gray scale voltage generator 1 463 and DAC 1 466 and a second duty ratio corresponding to gray scale voltage generator 2 464 and DAC 2 468. In implementations with additional available PWM duty ratios, there may be additional paired combinations of gray voltage scale generators and DACs available to the PWM controller 436.

The resulting analog pulsed signal is output to the display driver 458, which applies it to one of a series of gamma bands corresponding to peak luminance of the input display signal, and in turn outputs the gamma corrected and pulsed signal (also referred to herein as a pulse-modulated display signal) to the OLED display(s) 452 for visual representation to the user. In various implementations, the display driver 458 may also perform additional signal-processing on the display signal prior to output to the OLED display(s) 452. The series of available gamma bands and duty ratios may be stored within the memory device(s) 450 and/or the storage media device(s) 460 as formulae that are applied in real-time to the input display signal or a series of LUTs that contain values corresponding to the available gamma bands and duty ratios.

The computing system 400 may include a variety of tangible computer-readable storage media (e.g., the memory device(s) 450 and the storage media device(s) 460) and intangible computer-readable communication signals. Tangible computer-readable storage can be embodied by any available media that can be accessed by the computing system 400 and includes both volatile and non-volatile storage media, as well as removable and non-removable storage media implemented in any method or technology for storage of information such as computer readable instructions, data structures, program modules or other data. Tangible computer-readable storage media includes, but is not limited to, RAM, read-only memory (ROM), electrically erasable programmable read-only memory (EEPROM), flash memory or other memory technology, compact disc read-only memory (CD-ROM), digital versatile disks (DVD) or other optical disk storage, magnetic cassettes, magnetic tape, magnetic disk storage or other magnetic storage devices, or any other tangible medium which can be used to store the desired information and which can be accessed by the computing system 400. Tangible computer-readable storage media excludes intangible communications signals.

Intangible computer-readable communication signals may embody computer readable instructions, data structures, program modules or other data resident in a modulated data signal, such as a carrier wave or other signal transport mechanism. The term "modulated data signal" means a signal that has one or more of its characteristics set or changed in such a manner as to encode information in the signal. By way of example, and not limitation, intangible communication signals include signals traveling through wired media such as a wired network or direct-wired connection, and wireless media such as acoustic, radio-frequency (RF), infrared (IR), and other wireless media.

Some embodiments may comprise an article of manufacture. An article of manufacture may comprise a tangible storage medium to store logic. Examples of a storage medium may include one or more types of computer-readable storage media capable of storing electronic data, including volatile memory or non-volatile memory, removable or non-removable memory, erasable or non-erasable memory, writeable or re-writeable memory, and so forth. Examples of the logic may include various software elements, such as software components, programs, applications, computer programs, application programs, system programs, machine programs, operating system software, middleware, firmware, software modules, routines, subroutines, operation segments, methods, procedures, software interfaces, application program interfaces (APIs), instruction sets, computing code, computer code, code segments, computer code segments, words, values, symbols, or any combination thereof. In one embodiment, for example, an article of manufacture may store executable computer program instructions that, when executed by a computer, cause the computer to perform methods and/or operations in accordance with the described embodiments. The executable computer program instructions may include any suitable type of code, such as source code, compiled code, interpreted code, executable code, static code, dynamic code, and the like. The executable computer program instructions may be implemented according to a predefined computer language, manner or syntax, for instructing a computer to perform a certain operation segment. The instructions may be implemented using any suitable high-level, low-level, object-oriented, visual, compiled and/or interpreted programming language.

Some embodiments of the invention described herein are implemented as logical steps in one or more computer systems. The logical operations are implemented (1) as a sequence of processor-implemented steps executing in one or more computer systems and (2) as interconnected machine or circuit modules within one or more computer systems. The implementation is a matter of choice, dependent on the performance requirements of the computer system implementing the invention. Accordingly, the logical operations described herein are referred to variously as operations, steps, objects, or modules. Furthermore, the logical operations may be performed in any order, adding or omitting operations as desired, unless explicitly claimed otherwise or a specific order is inherently necessitated by the claim language.

An example computing device according to the presently disclosed technology comprises a self-emitting electroluminescent display and a pulse-width modulation (PWM) controller. The PWM controller calculates a gray portion of an input display signal, selects a PWM duty ratio based on the calculated gray portion, and outputs a pulse-modulated display signal to the display.

Another example computing device according to the presently disclosed technology further comprises a display driver. The display driver selects a gamma band corresponding to peak luminance of the input display signal, and applies the selected PWM duty ratio to the selected gamma band to create the pulse-modulated display signal output to the display.

In another example computing device according to the presently disclosed technology, the PWM controller includes a gray portion calculator and a duty ratio selector. The gray portion calculator calculates the gray portion of the input display signal and the duty ratio selector selects the PWM duty ratio based on the calculated gray portion.

In another example computing device according to the presently disclosed technology, the PWM controller includes a display frame buffer to store the input display signal.

In another example computing device according to the presently disclosed technology, the PWM controller includes a timing controller to generate a pulsed signal that matches the selected PWM duty ratio.

In another example computing device according to the presently disclosed technology, the PWM controller includes a gray scale voltage generator and a digital-to-analog converter (DAC) corresponding to each PWM duty ratio available to the PWM controller.

In another example computing device according to the presently disclosed technology, the PWM duty ratio ranges from 10% to 100%.

Another example computing device according to the presently disclosed technology further comprises a storage device to store a series of PWM duty ratios from which the PWM duty ratio is selected.

In another example computing device according to the presently disclosed technology, each of the series of PWM duty ratios correspond to a range of gray portion between 0 and 255 G.

Another example computing device according to the presently disclosed technology further comprises a storage device to store a series of gamma bands from which the gamma band is selected.

In another example computing device according to the presently disclosed technology, the PWM duty ratio is selected from one or more look-up tables (LUTs) within the storage device.

In another example computing device according to the presently disclosed technology, the gray portion is calculated in real time using one or more formulae stored within the storage device.

In another example computing device according to the presently disclosed technology, the display is an organic light-emitting diode (OLED) display.

An example method of modulating an output for a display according to the presently disclosed technology comprises receiving an input display signal, calculating a gray portion of the input display signal, selecting a pulse-width modulation (PWM) duty ratio based on the calculated gray portion, applying the selected PWM duty ratio to the input display signal to create a pulse-modulated display signal, and outputting the pulse-modulated display signal to the display.

Another example method of modulating an output for a display according to the presently disclosed technology further comprises selecting a gamma band corresponding to peak luminance of the input display signal, and applying the selected PWM duty ratio to the selected gamma band to create the pulse-modulated display signal output to the display.

Another example method of modulating an output for a display according to the presently disclosed technology further comprises storing a series of PWM duty ratios from which the PWM duty ratio is selected from on a storage device.

In another example method of modulating an output for a display according to the presently disclosed technology, the PWM duty ratio is selected from one or more look-up tables (LUTs) within the storage device.

In another example method of modulating an output for a display according to the presently disclosed technology, the gray portion is calculated in real time using one or more formulae stored within the storage device.

An example computer-readable medium containing processor-executable instructions according to the presently disclosed technology that, when executed by a processor, cause the processor to receive an input display signal, calculate a gray portion of the input display signal, select a pulse-width modulation (PWM) duty ratio based on the calculated gray portion, apply the selected PWM duty ratio to the input display signal to create a pulse-modulated display signal, and output the pulse-modulated display signal to a display.

In another example computer-readable medium containing processor-executable instructions according to the presently disclosed technology, the processor-executable instructions further cause the processor to select a gamma band corresponding to peak luminance of the input display signal, and apply the selected PWM duty ratio to the selected gamma band to create the pulse-modulated display signal output to the display.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A computing device comprising:

a self-emitting electroluminescent display;

a pulse-width modulation (PWM) controller to calculate a gray portion of an input display signal, select a PWM duty ratio based on the calculated gray portion, and output a pulse-modulated display signal to the display; and a display driver to select a gamma band corresponding to peak luminance of the input display signal, and apply the selected PWM duty ratio to the selected gamma band when the peak luminance exceeds a predetermined PWM threshold to create the pulse-modulated display signal output to the display.

2. The computing device of claim 1, wherein the PWM controller includes:

a gray portion calculator to calculate the gray portion of the input display signal; and a duty ratio selector to select the PWM duty ratio based on the calculated gray portion.

3. The computing device of claim 1, wherein the PWM controller includes a display frame buffer to store the input display signal.

4. The computing device of claim 1, wherein the PWM controller includes a timing controller to generate a pulsed signal that matches the selected PWM duty ratio.

5. The computing device of claim 1, wherein the PWM controller includes a gray scale voltage generator and a digital-to-analog converter (DAC) corresponding to each PWM duty ratio available to the PWM controller.

6. The computing device of claim 1, wherein the PWM duty ratio ranges from 10% to 100%.

7. The computing device of claim 1, further comprising:
a storage device to store a series of PWM duty ratios from which the PWM duty ratio is selected.

8. The computing device of claim 7, wherein each of the series of PWM duty ratios correspond to a range of gray portion between 0 and 255 G.

9. The computing device of claim 7, wherein the PWM duty ratio is selected from one or more look-up tables (LUTs) within the storage device.

10. The computing device of claim 7, wherein the gray portion is calculated in real time using one or more formulae stored within the storage device.

11. The computing device of claim 1, further comprising:
a storage device to store a series of gamma bands from which the gamma band is selected.

12. The computing device of claim 1, wherein the display is an organic light-emitting diode (OLED) display.

13. The computing device of claim 1, wherein the PWM duty ratio is selected from three or more available PWM duty ratios.

14. A method of modulating an output for a display comprising:
receiving an input display signal;
calculating a gray portion of the input display signal;
selecting a pulse-width modulation (PWM) duty ratio based on the calculated gray portion;
applying the selected PWM duty ratio to the input display signal to create a pulse-modulated display signal;
outputting the pulse-modulated display signal to the display;
selecting a gamma band corresponding to peak luminance of the input display signal; and
applying the selected PWM duty ratio to the selected gamma band when the peak luminance exceeds a predetermined PWM threshold to create the pulse-modulated display signal output to the display.

15. The method of claim 14, further comprising:
storing a series of PWM duty ratios from which the PWM duty ratio is selected from on a storage device.

16. The method of claim 15, wherein the PWM duty ratio is selected from one or more look-up tables (LUTs) within the storage device.

17. The method of claim 15, wherein the gray portion is calculated in real time using one or more formulae stored within the storage device.

18. The method of claim 14, wherein the PWM duty ratio is selected from three or more available PWM duty ratios.

19. A computer-readable medium containing processor-executable instructions that, when executed by a processor, cause the processor to:
receive an input display signal;
calculate a gray portion of the input display signal;
select a pulse-width modulation (PWM) duty ratio based on the calculated gray portion;
apply the selected PWM duty ratio to the input display signal to create a pulse-modulated display signal;
output the pulse-modulated display signal to a display;
select a gamma band corresponding to peak luminance of the input display signal; and
apply the selected PWM duty ratio to the selected gamma band when the peak luminance exceeds a predetermined PWM threshold to create the pulse-modulated display signal output to the display.

20. The computer-readable medium of claim 19, wherein the PWM duty ratio is selected from three or more available PWM duty ratios.

* * * * *